US006394856B1

(12) United States Patent
Wertz

(10) Patent No.: US 6,394,856 B1
(45) Date of Patent: May 28, 2002

(54) ELECTRICAL CONNECTOR WITH PROGRAMMABLE KEYING

(75) Inventor: Darrell Lynn Wertz, York, PA (US)

(73) Assignee: Tyco Electronics Corp., Wilimington, DE (US)

( * ) Notice: Subject to any disclaimer, the term of this patent is extended or adjusted under 35 U.S.C. 154(b) by 0 days.

(21) Appl. No.: 09/477,587

(22) Filed: Jan. 4, 2000

(51) Int. Cl.[7] ..... H01R 13/64
(52) U.S. Cl. ..... 439/681
(58) Field of Search ..... 439/681, 679, 439/680, 171, 173, 289

(56) References Cited

U.S. PATENT DOCUMENTS 4,229,064 A * 10/1980 Vetter et al. ..... 439/284
4,990,099 A * 2/1991 Marin et al. ..... 439/284

* cited by examiner

*Primary Examiner*—Gary Paumen
*Assistant Examiner*—Alexander Gilman

(57) ABSTRACT

An electrical connector (22) having an array of terminals (50) disposed in respective terminal receiving passageways (30) therein and a programmable keying member (60) disposed into a key receiving opening (32) extending into the mating face (26) among the array of terminal receiving passageways (30). The key receiving opening (32) is configured to receive the keying member (60) in any of a plurality of orientations. The keying member (60) further may include other terminals (82, 84) disposed in terminals receiving passageways (78, 80) of the keying member (60).

15 Claims, 10 Drawing Sheets

ELECTRICAL CONNECTOR WITH PROGRAMMABLE KEYING

FIELD OF THE INVENTION

The present invention is directed to electrical connectors and more particularly to keying systems for electrical connectors.

BACKGROUND OF THE INVENTION

When mating electrical connections various methods are used to assure that connectors are mated correctly. This is particularly important when, for example, a series of electrical cables are to be connected to the same device. If the cables have different numbers of conductors or different sizes of conductors to be terminated to a connector, the connectors generally will be different sizes and, therefore, easy to match to the mating connector of the device. In addition to size differences, the connectors may also be polarized to assure correct orientation of the connectors prior to mating. The housing may have an asymmetric shape, such as, for example, a D-shape, or an interlocking rib and notch along a wall of the housing or other orientating features, as known in the art.

If, however, the cables are substantially identical and an array of same size and shape connectors are to be terminated to the cables, a keying system is also used to assure that the correct pairs of connectors are mated. Various systems have been used, such as plugs that are inserted into selected terminal passageways or keying features on flanges that extend outwardly from the sides of the housings.

To be cost effective it is desirable that the keying system be one that is programmable, that is, the key can be changed from one position to another in the same connector housing, thus eliminating the need to stock many differently keyed housings.

It is further desirable that the keying system be one that permits connectors to be spaced closely together on a back plane or the like to help minimize the size of the device being manufactured.

SUMMARY OF THE INVENTION

The present invention is directed to an electrical connector having a keying system that overcomes problems associated with the prior art. The connector includes a housing with a mating face and an assembly face and an array of terminal receiving passageways extending therebetween, a plurality of terminals, and a programmable keying member. Each terminal is disposed in a respective terminal receiving passageway. The housing includes a key receiving opening extending into the mating face disposed among the array of the terminal receiving passageways and configured to receive the keying member in any of a plurality of orientations.

The invention is further directed to a connector wherein the key receiving opening extends to the assembly face and the keying member further includes at least one other terminal disposed in a terminal receiving passageway of the keying member.

For purposes of illustrating the invention, the connector is shown as a shielded circular power connector having ground, neutral and power terminals and a keying member that includes signal terminals. The signal terminals may be used, for example, to transmit control signals through the connector to an apparatus. It is to be understood that the invention is not limited to circular connectors nor to shielded connectors nor to power connectors. Furthermore the keying member may include no additional terminals, terminals that are similar to the other terminals in the connector or terminals that are dissimilar to the other terminals.

The present invention provides a keying system that is contained within the outer profile of the connector housing and does not extend outwardly from the ends or exterior walls of the connector thereby enabling the connectors to be spaced closely together on a back plane or the like.

An embodiment of the invention will now be described by way of example with reference to the accompanying drawings.

DETAILED DESCRIPTION OF AN EMBODIMENT OF THE INVENTION

Figure 1:
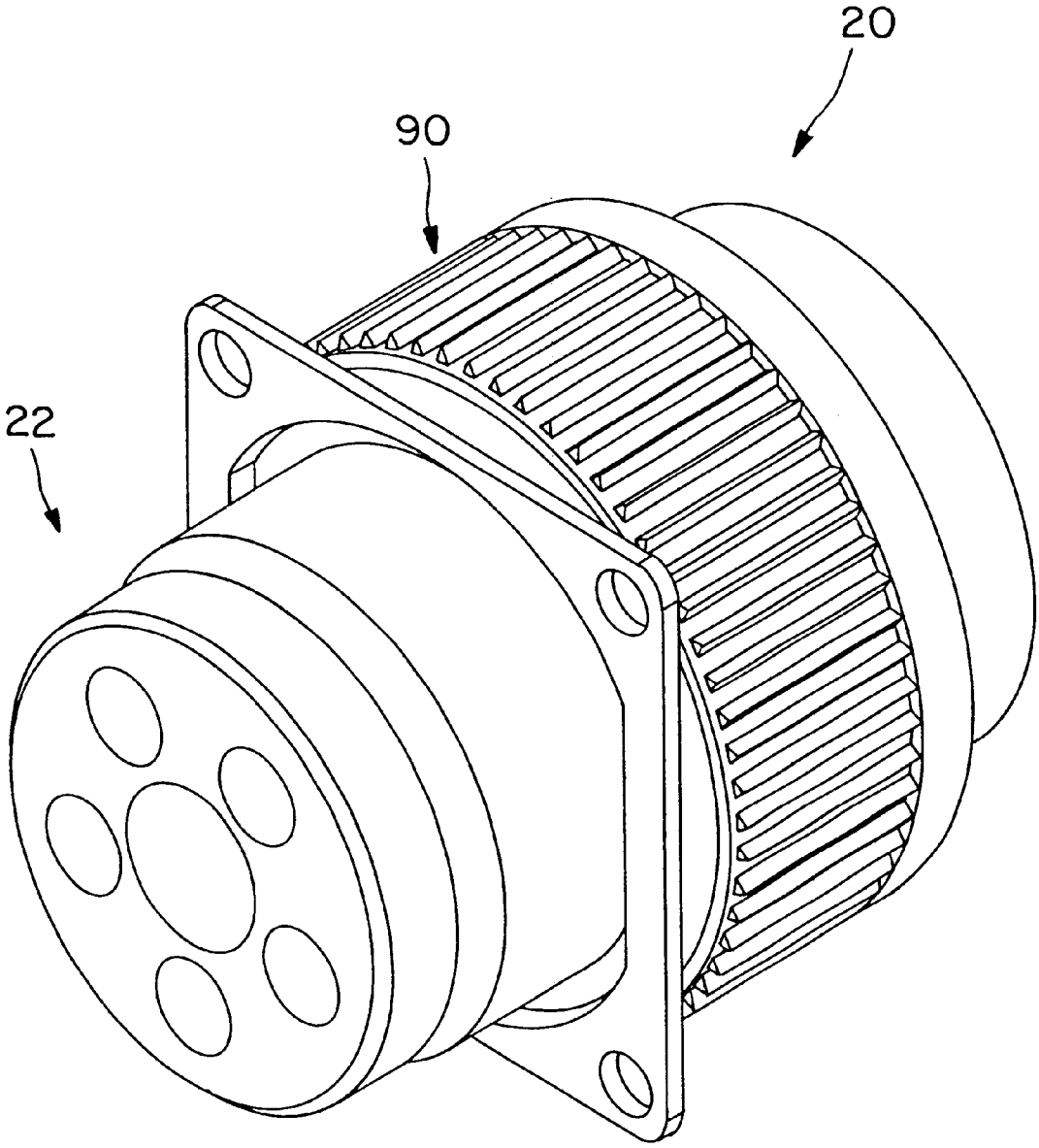
FIG. 1 is an isometric view of a connector assembly having first and second connectors made in accordance with the invention with the conductors eliminated for purposes of illustration.
Figure 2:
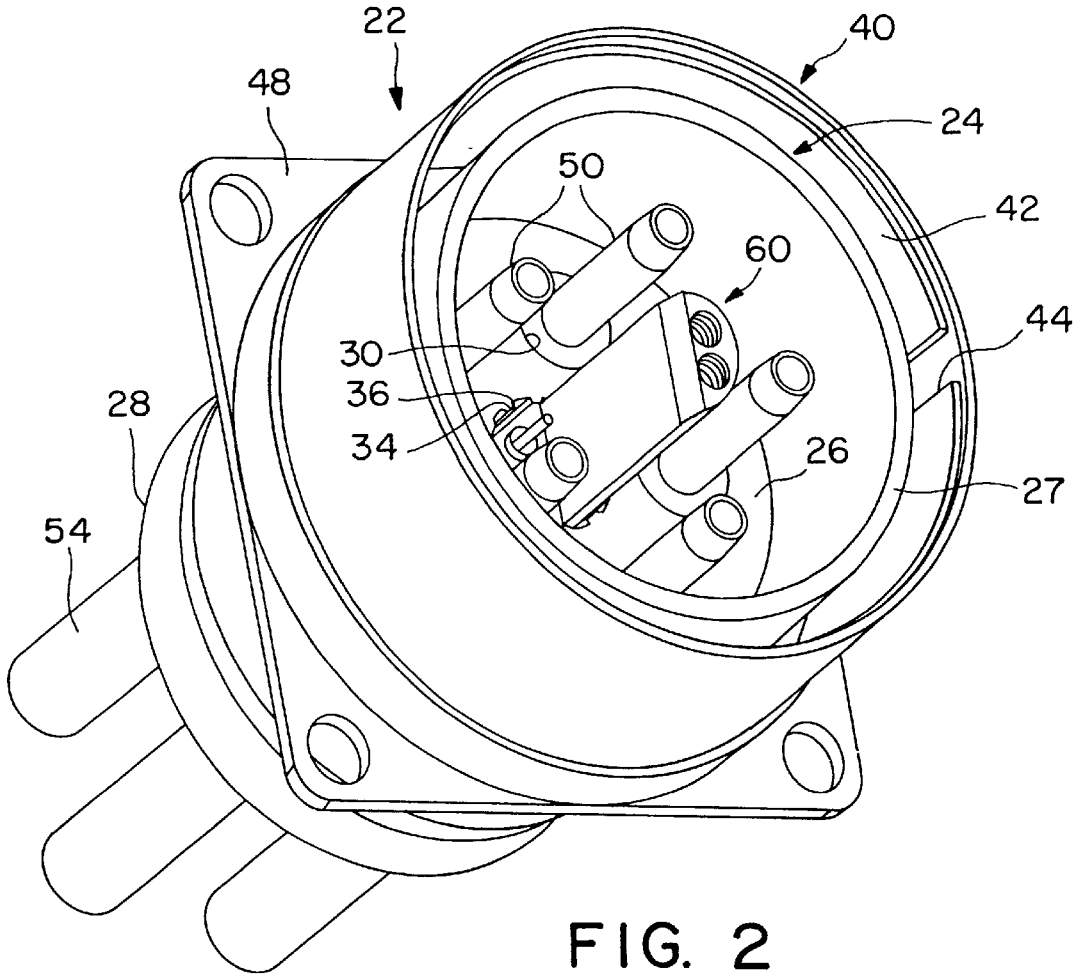
FIG. 2 is an isometric view of the first connector of FIG. 1 illustrating the terminals and keying member thereof.
Figure 3:
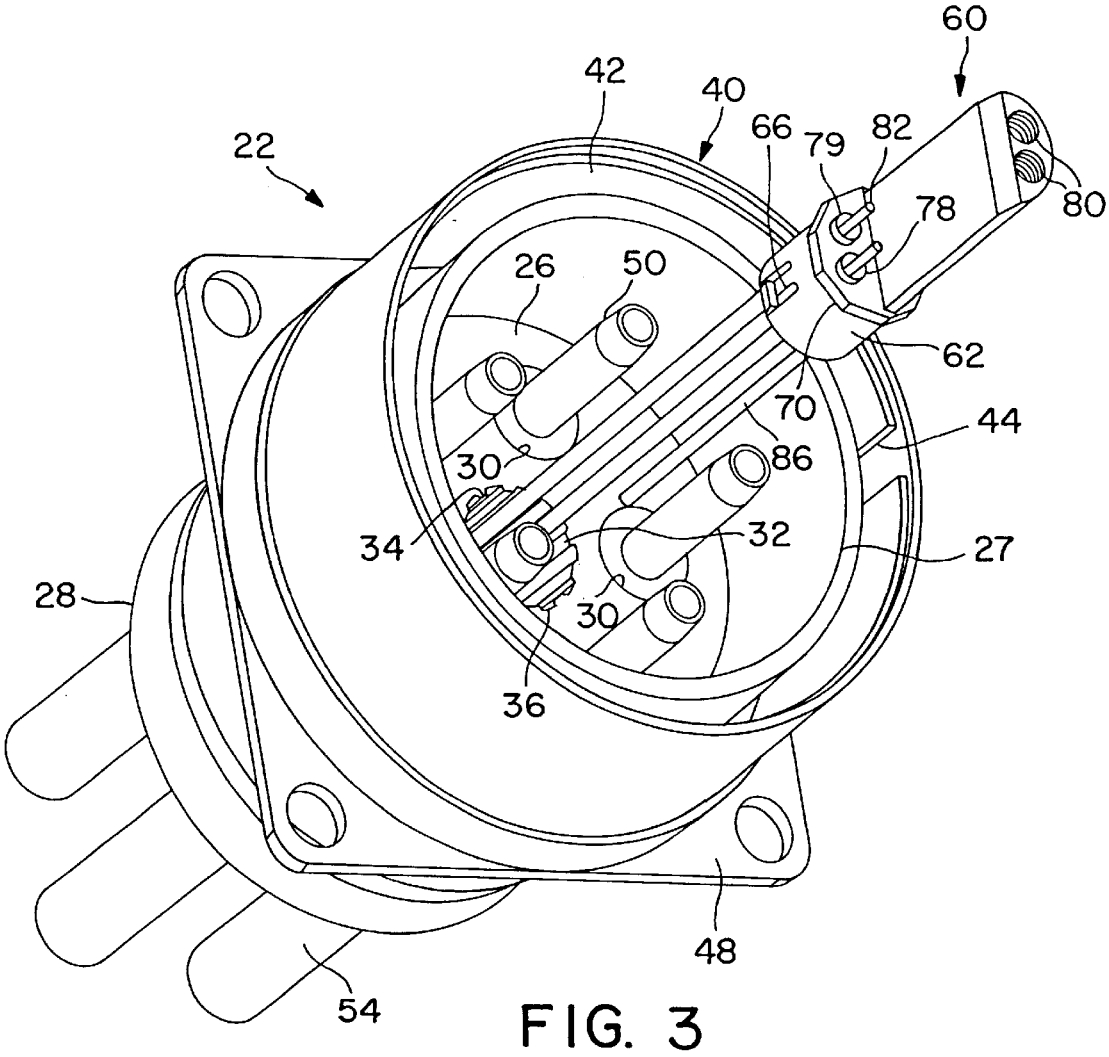
FIG. 3 is a view similar to that of FIG. 2 with the keying member exploded therefrom.
Figure 4:
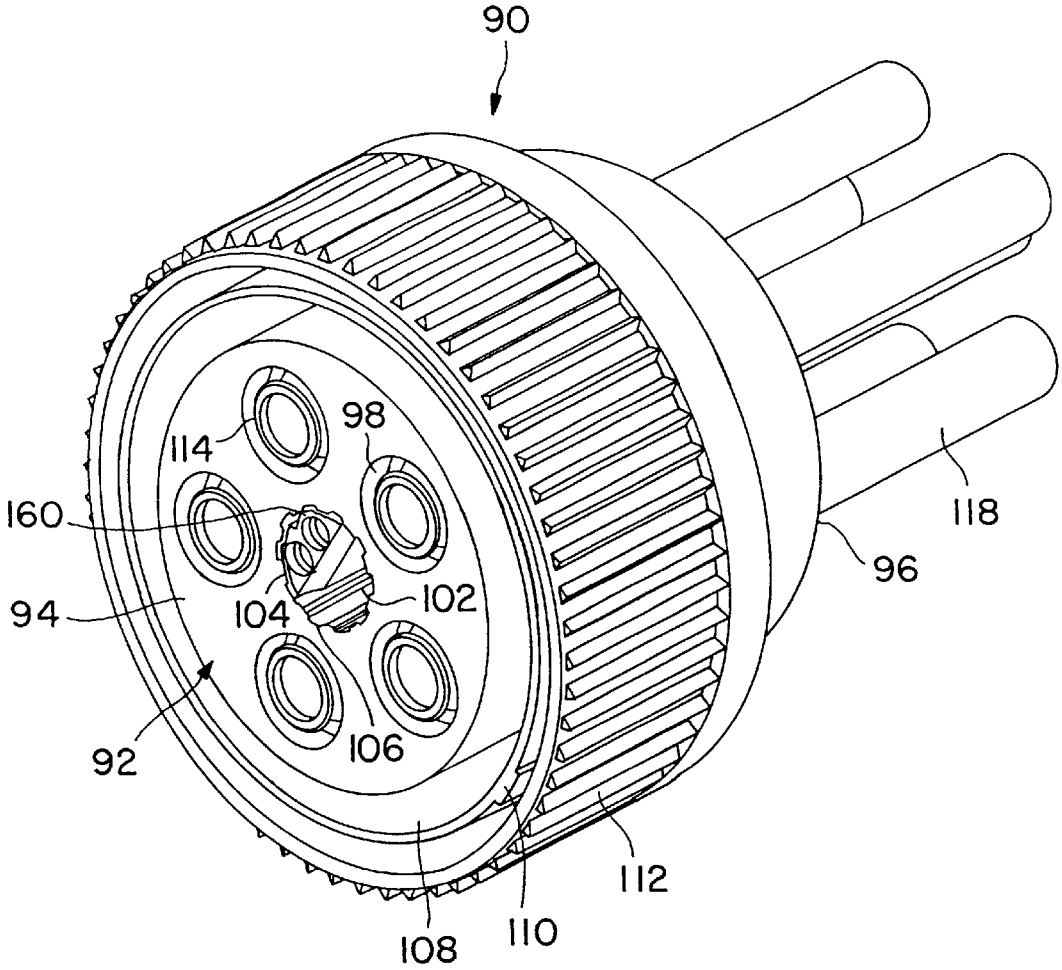
FIG. 4 is an isometric view of the second connector of FIG. 1 illustrating the terminals and keying member thereof.
Figure 5:
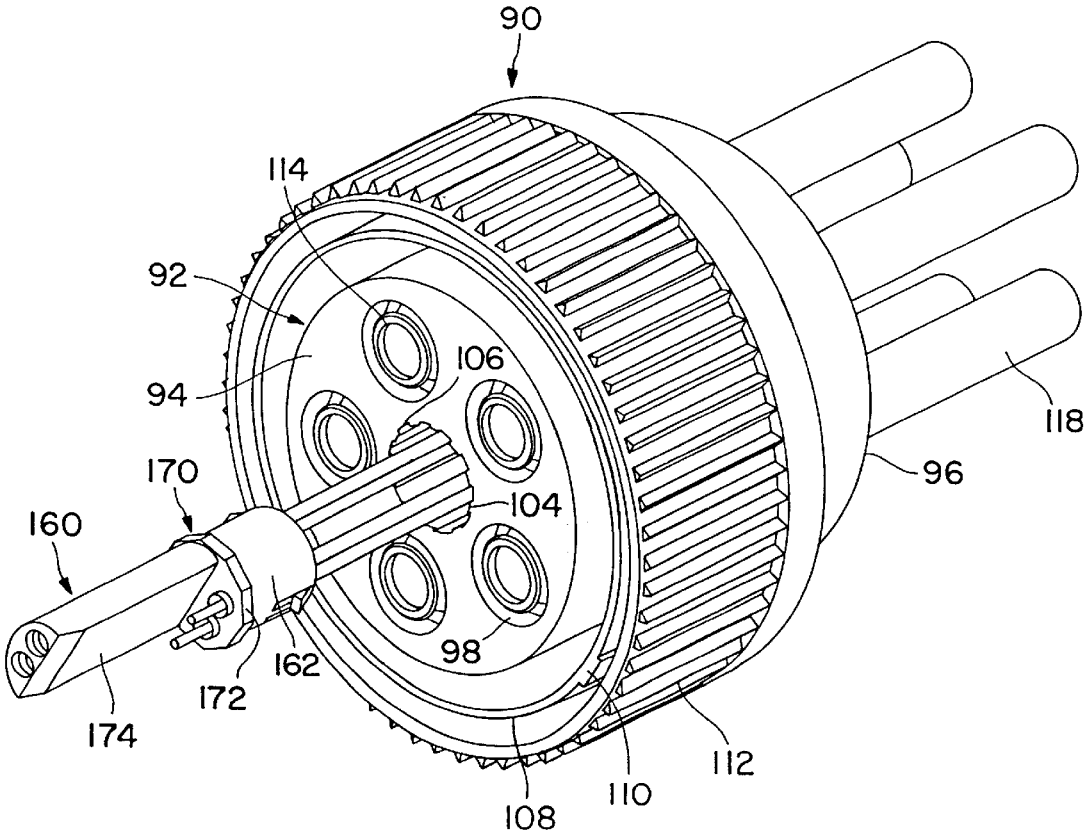
FIG. 5 is a view similar to that of FIG. 4 with the keying member exploded therefrom.

Referring first to FIGS. 1 through 3 and 7, connector assembly 20 includes first connector 22 and second connector 90. For purposes of illustration connector assembly 20 is a shielded circular power connector. Connector 22 includes a dielectric housing 24, having a mating face 26 surrounded by shroud 27, an assembly face 28, and a plurality of terminal receiving passageways 30 extending therebetween. A polygonal key receiving opening 32 extends into the dielectric housing 24 from the mating face 26 and is disposed among the array of terminal receiving passageways 30. Opening 32 includes a plurality of sides 34, each having a latch receiving notch or slot extending therealong and configured to receive a keying member 60 as described more fully below. Connector 22 includes a plurality of terminals 50, each terminal 50 being disposed in a respective terminal receiving passageway 30. As shown in FIGS. 2 and 3, terminals 50 are pin terminals that extend forwardly from mating face 26 and are surrounded by shroud 27. Each terminal 50 is terminated to a respective conductor 54. Typically, in a power connector, the terminals are sequenced such that the terminal connected to ground is engaged prior to the other terminals. Connector 22 further includes a conductive shell or shield 40 surrounding dielectric housing 24. Shell 40 includes an inner ring having a polarizing opening 44, as known in the art.

Figure 7:
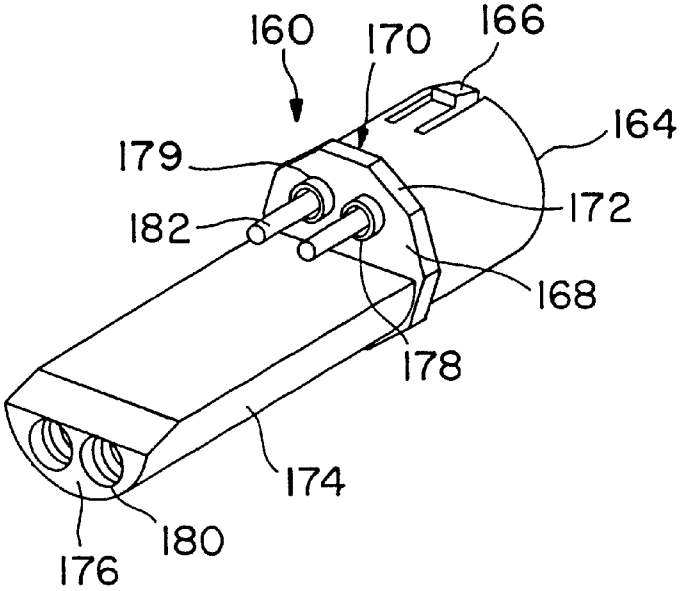
FIG. 7 is an isometric view of the keying members of the respective connectors of FIGS. 2 and 4, exploded from one another.
Figure 7:
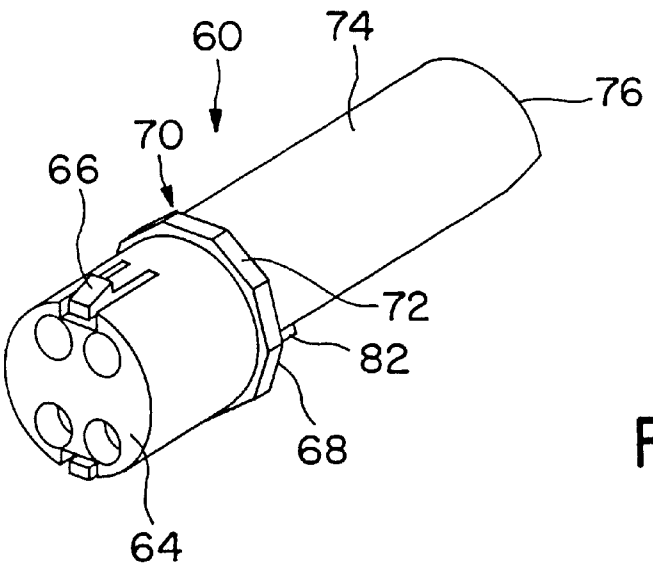
Figure 9:
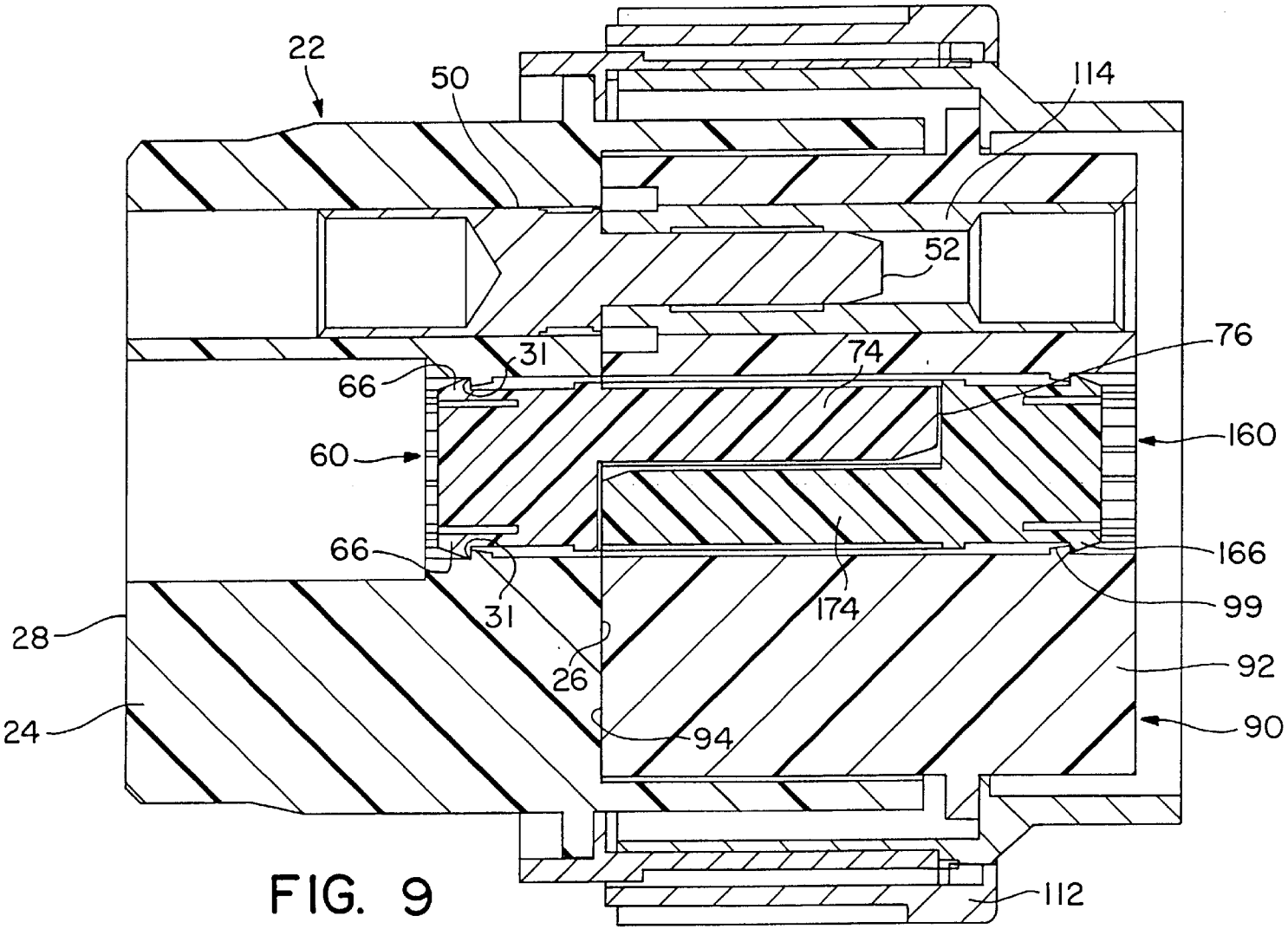
FIG. 9 is a cross sectional view of the mated connector assembly of FIG. 1 illustrating the mated keying members and a mated pair of terminals from the connectors.

Keying member 60, as best seen in FIGS. 2, 3 and 7, includes a cylindrical body 62 having an assembly face 64 and mating face 68. Body 62 includes at least one latch 66 for securing the keying member in passageway 32. In the embodiment shown body 62 includes a pair of latches 66 proximate the assembly face thereof for securing keying member 60 within key receiving opening 32 of housing 24. Body 62 includes a polygonal flange 70 extending therearound proximate the mating face 68. Flange 70 includes a plurality of sides 72 equal in number to those of opening 32. In the connector as illustrated, flange 70 and opening 32 each contain 10 sides. Keying member 60 further includes a semi-cylindrical column 74 extending forwardly from the mating face 68 to a leading end 76 and dimensioned to be longer than terminals 50 of connector 22. to assure key 60 is mated to the complementary key prior to any of the terminals being mated, as best seen in FIG. 9.

To transmit control signals through the power connector assembly 20, keying member 60 further includes a plurality of first and second signal terminals 82, 84 disposed in respective first and second terminal receiving passageways 78, 80. For purposes of illustration, the first signal terminals 82 are shown as pin terminals and the second signal terminals 84 are shown as socket terminals, each being matable to complementary terminals 184, 182 in a mating keying member 160, as shown in FIG. 7. Each signal terminal 82, 84 is terminated to a respective conductor 86, as shown in FIG. 3. Since the pin terminals 82 of keying member 60 are relatively close together a dielectric collar 79 is provided around each of the terminals 82 to increase the creep distance and reduce the chance of arcing between the terminals. It should be recognized that in other applications the terminals in the keying member may carry signals or power.

Referring now to FIGS. 4 through 7, second connector 90 includes a dielectric housing 92, having a mating face 94, an assembly face 96, and a plurality of terminal receiving passageways 98 extending therebetween. A polygonal key receiving opening 102 extends into the dielectric housing 92 from the mating face 94 and is disposed among the array of terminal receiving passageways 98. Opening 102 includes a plurality of sides 104, and latch receiving notches or slots, as described above and configured to receive a keying member 160. Connector 90 includes a plurality of terminals 114, each disposed in a respective terminal receiving passageway 98 and terminated to a respective conductor 118. Terminals 114 are socket terminals as best seen in FIG. 9. Connector 90 further includes a conductive shell 108 disposed around dielectric housing 92 and an inner locking knurled ring 112 is used to hold the shielded connectors together as known in the art. Conductive shell 108 includes a polarizing protrusion 110 extending outwardly therefrom and dimensioned to be received in slot 44 of connector 22.

Figure 6:
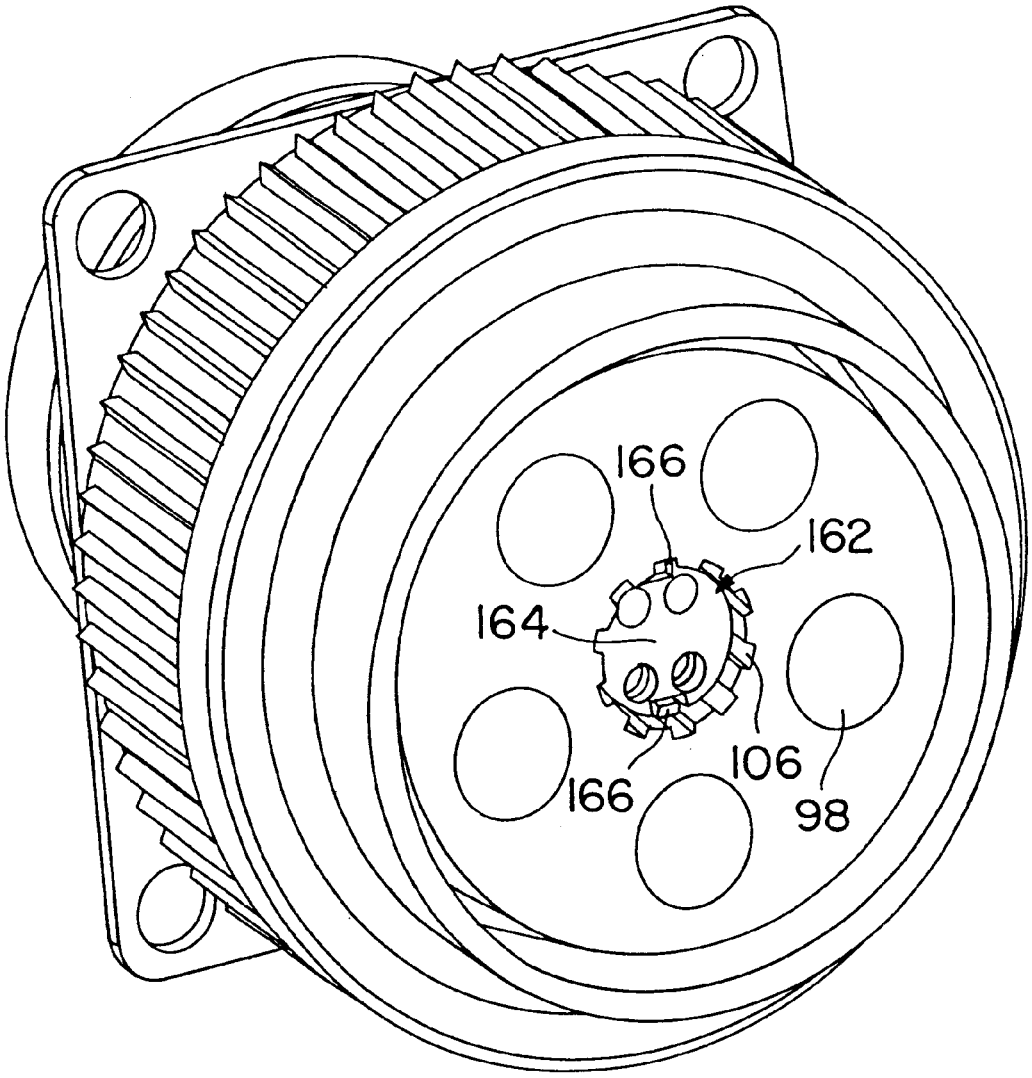
FIG. 6 is an isometric view of the connector assembly of FIG. 1 as viewed from the assembly face of the connector of FIG. 4.

In the embodiment as illustrated, keying members 60 and 160 are hermaphroditic. It is to be understood that the keying members do not need to be the same. Keying member 160 includes a body 162 having an assembly face 164 and mating face 168. At least one latch 166 and as shown here, a pair of latches 166 are positioned proximate the assembly face 164 for securing keying member 160 within key receiving opening 102 of housing 92, as shown in FIG. 6. Body 162 has a polygonal flange 170 having a plurality of sides 172 equal in number to those of opening 102. Keying member 160 includes a semi-cylindrical column 174 extending to a leading end 176 as described above. Keying member 160 includes first and second terminal receiving passageways 178, 180, having first or pin and second or socket terminals 182, 184 therein, each terminated to a conductor 186. A dielectric collar 179 is provided around terminals 182 to increase the creep distance.

Connector 22 is assembled by terminating conductors 54 to terminals 50 and inserting terminals 50 into respective terminal receiving passageways 30 from assembly face 28. Conductors 86 are inserted through key receiving opening 32 and terminated to terminals 82, 84, which are then inserted into key member 60 from the assembly face 64. Keying member 60 is assembled to connector 22 by inserting body 62 into opening 32 from the mating face 26 of housing 24 in the desired orientation. As best seen in FIG. 6, the keying member may be repositioned by depressing the latches and removing the keying member from the mating face of the housing and reinserting it in a different orientation. Connector 90 is assembled in a similar manner. The respective shells 40, 108 are disposed over the assembled connectors.

Figure 8:
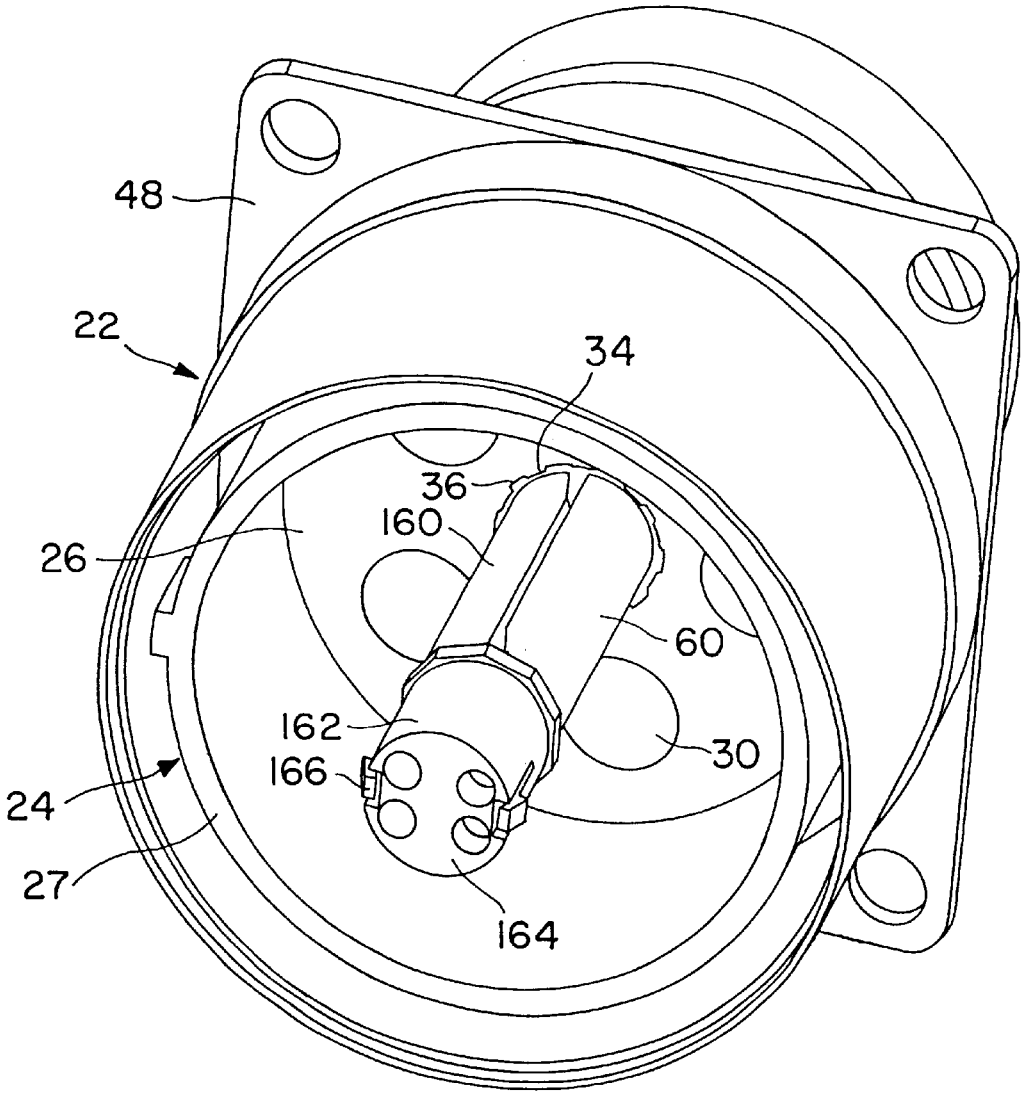
FIG. 8 is an isometric view of the connector of FIG. 3 with the keying member of the connector of FIG. 4 mated thereto.
Figure 10:
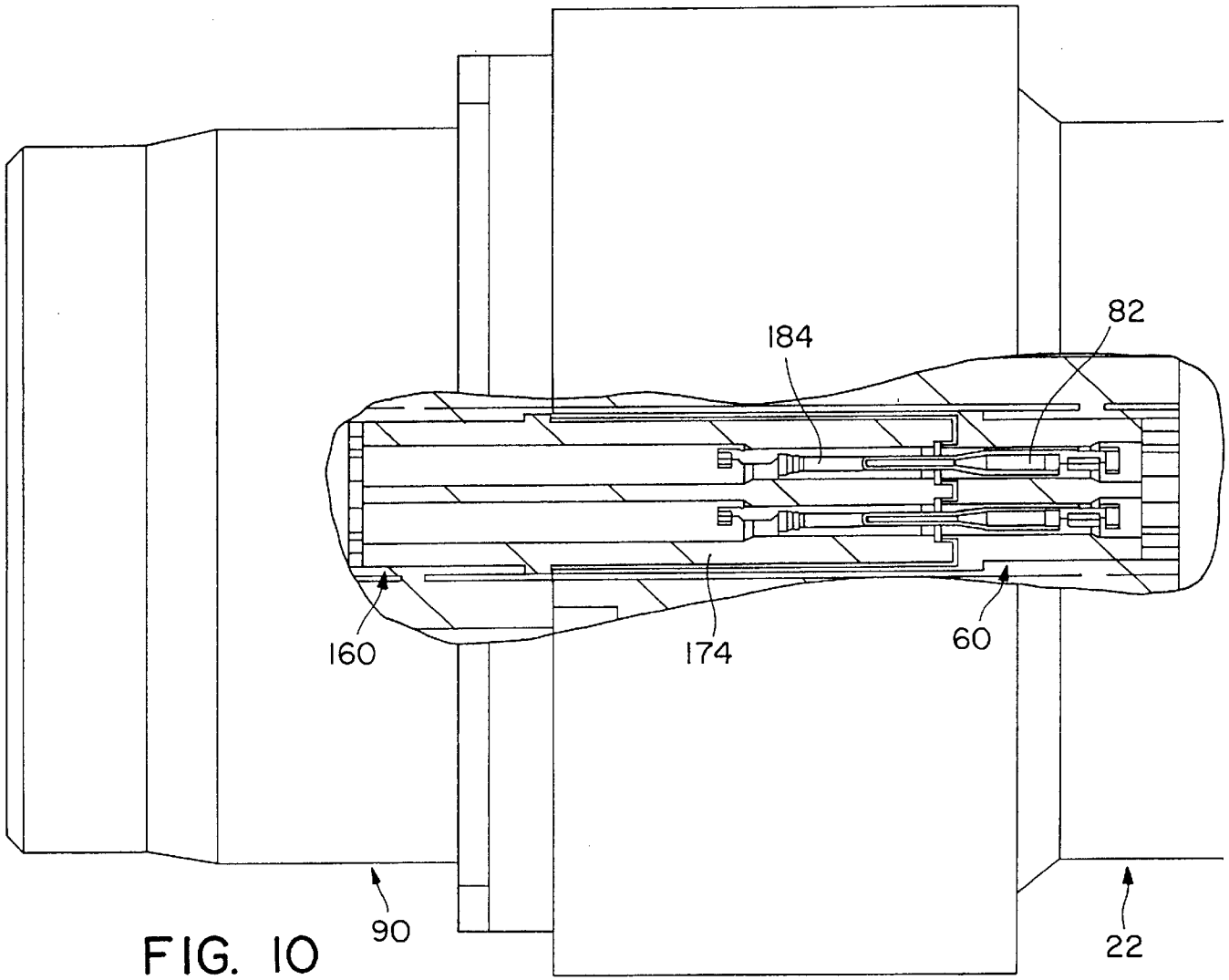
FIG. 10 is a partially sectioned view of the assembly of FIG. 1 illustrating the mated terminals of the keying members.

FIGS. 8, 9, and 10 illustrate the mating of the keying members 60, 160, the connectors 22, 90 and terminals 50, 114 thereof. FIG. 8 shows the two keying members 60 and 160 mated to one another with keying member 60 disposed in connector 22. For purposes of illustration connector 90 is not shown. FIG. 9 is a cross sectional view of the mated connectors showing the position of the columns 74, 174 of the mated connectors and one of the power pin terminals 50 mated to a socket terminal 114. FIG. 9 also shows the latches 66 and 166 disposed in respective housings and latched to latching surfaces 31 and 99 of key receiving openings 32, 102. FIG. 10 illustrates the mating of the terminals 82 and 184 of the mating keying members 60, 160.

When mating the connectors 22, 90, the polarizing protrusion 110 of connector 90 must first be received in polarizing slot 44 of connector to properly align the various terminals. Even if the connectors have been properly oriented with respect to the polarizing feature 110, mating can only occur if the keying members are properly aligned, after which the connectors can be brought together and the corresponding terminals can be mated. In the embodiment shown, the keying members 60, 160 can be positioned in ten different orientations within the respective openings 32, 102. Thus, for example, an array of ten connectors, each having a different position for the keying member, can be mounted to a back plane, and mated only to a complementary connector having the same keying orientation.

The connector assembly and keying member of the present invention mating housings that can be keyed in a number of different orientations. The hermaphroditic keying member means that only one member needs to be manufactured and stocked by an equipment manufacturer. The keying member is easily repositioned by the manufacturer thus eliminating the need to stock multiple connectors, each with a different keying orientation.

It is thought that the electrical connector and the programmable keying member of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector comprising:

a housing having a mating face, an assembly face, an array of terminal receiving passageways extending between the two faces and a key receiving opening extending into the mating face and disposed among the array of terminal receiving passageways; and a programmable keying member maintained in the key receiving opening, the keying member including a body having a polygonal flange extending therearound and the key receiving opening having a like polygonal shape configured to receive the keying member in a plurality of orientations.

2. The electrical connector of claim 1 wherein the key receiving opening includes a latch receiving slot in each side of the polygonal shape and the body of the keying member includes at least one latch extending outwardly therefrom dimensioned to be received in any of the slots of the opening.

3. The electrical connector of claim 1 wherein the keying member includes a body having a columnar portion extending forwardly from the body for engaging a complementary keying member of a mating connector.

4. The electrical connector of claim 1 wherein the key receiving opening extends to the assembly face and the keying member comprises a body having at least one terminal receiving passageway and a terminal disposed in the at least one terminal receiving passageway of the keying member.

5. The electrical connector of claim 4 wherein the keying member includes a body having a polygonal flange extending therearound and the key receiving opening has a like polygonal shape configured to receive the keying member in a plurality of orientations.

6. The electrical connector of claim 5 wherein the key receiving opening includes a latch receiving slot in each side of the polygonal shape and the body of the keying member includes at least one latch extending outwardly therefrom dimensioned to be received in any of the slots of the opening.

7. The electrical connector of claim 4 wherein the body of the keying member further comprises a columnar portion extending forwardly from the body for engaging a complementary keying member of a mating connector.

8. The electrical connector of claim 4 wherein the key receiving opening extends to the assembly face and the columnar portion further comprises at least one terminal receiving passageway and a terminal disposed in the at least one terminal receiving passageway of the columnar portion.

9. An electrical connector assembly comprising:

first and second connectors, each connector including a housing having an array of terminals receiving passageways extending between a mating face and an assembly face thereof;

each housing further comprises a key receiving opening extending into the mating face and disposed among the array of terminal receiving passageways; and each housing further comprising a programmable keying member maintained in the key receiving opening, the keying member including a body having a polygonal flange extending therearound and the key receiving opening having a like polygonal shape configured to receive the keying member in a plurality of orientations.

10. The electrical connector assembly of claim 9 wherein each the key receiving opening includes a latch receiving slot in each side of the polygonal shape and the body of the keying member includes at least one latch extending outwardly therefrom dimensioned to be received in any of the slots of the opening.

11. The electrical connector assembly of claim 9 wherein the each the key receiving opening extends to the assembly face and each the keying member further includes at least one terminal receiving passageway anda terminal disposed in the at least one terminal receiving passageway of the keying member.

12. The electrical connector assembly of claim 11 wherein the body of each keying member has a polygonal flange extending therearound and the corresponding key receiving opening has a like polygonal shape configured to receive the keying member in a plurality of orientations.

13. The electrical connector assembly of claim 9 wherein each keying member includes a body having a columnar portion extending forwardly from the body for engaging a complementary keying member of a mating connector.

14. The electrical connector assembly of claim 13 wherein each columnar portion is semi-cylindrical and includes at least one complementary terminal adapted to mate with a corresponding one of the at least one terminal of a mating key receiving member.

15. The electrical connector assembly of claim 9 wherein the keying members of the first and second connectors are hermaphroditic.

* * * * *